United States Patent [19]

Bonnot

[11] 4,019,634

[45] Apr. 26, 1977

[54] COLLAPSIBLE SHIPPING CONTAINER

[76] Inventor: Pierre Edmond Michel Bonnot, 3 Place Marine, Maisons-Laffitte, France

[22] Filed: Mar. 19, 1975

[21] Appl. No.: 560,263

[52] U.S. Cl. ..... 206/386; 108/53.3; 229/23 R

[51] Int. Cl.[2] ..... B65D 19/00

[58] Field of Search ..... 206/386; 229/23 R, 30; 108/53, 56, 58

[56] References Cited

UNITED STATES PATENTS

| | | | |
|---|---|---|---|
| 2,484,975 | 10/1949 | Van Saun | 229/23 R |
| 2,699,912 | 1/1955 | Cushman | 108/56 |
| 3,100,046 | 8/1963 | Wetmore et al. | 206/386 |
| 3,357,628 | 12/1967 | Fish | 229/23 R |
| 3,493,101 | 2/1970 | Collin | 206/280 |
| 3,524,415 | 8/1970 | Heiman | 108/53 |
| 3,537,635 | 11/1970 | Reas | 206/386 X |
| 3,650,459 | 3/1972 | Tucker | 206/386 |
| 3,680,496 | 8/1972 | Westlake, Jr. | 108/58 |
| 3,771,714 | 11/1973 | Faires et al. | 229/37 R |

*Primary Examiner*—Steven E. Lipman
*Attorney, Agent, or Firm*—Edward E. Ayson; John J. Byrne

[57] ABSTRACT

Disclosed is a collapsible shipping container comprising an upper storage section and a lower pallet section secured to said upper section by a plurality of pins. The upper storage section includes a pair of U-shaped panels which, when fastened to the pallet section, form four sides of the shipping container. A detachable lid is thereafter secured to the top of said container by straps and said lid, said panels, and said pallet form the interior surfaces of said shipping container. The pallet includes upper and lower sections which are connected together through raised portions thereby forming a plurality of foot pedestals. The resulting pallet is accessible by fork lift truck from any direction and can be swung by any crane. A unique resilient snap-lock fastener comprising a pair of resilient arms extending from a base and adapted to pass through a recess in said pallet section and to engage a lip located internal to said pedestals secures said panel sections to said pallet section. The fastener may be inserted manually and the shipping container may be erected or collapsed with ease. The container is additionally equipped with a plurality of thrust-absorbing tabs for improved structural integrity and cardboard plys which permit easy inspection.

14 Claims, 5 Drawing Figures

Fig. 1
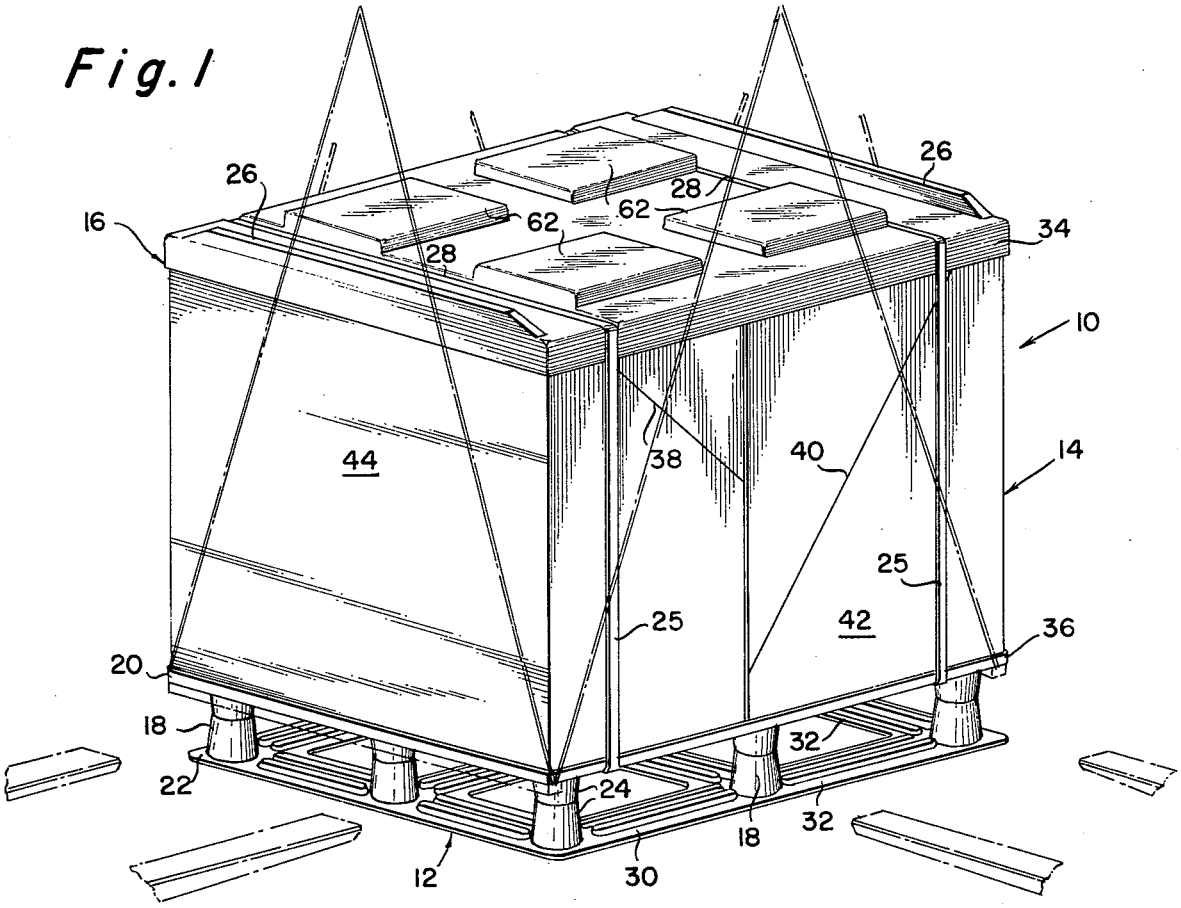
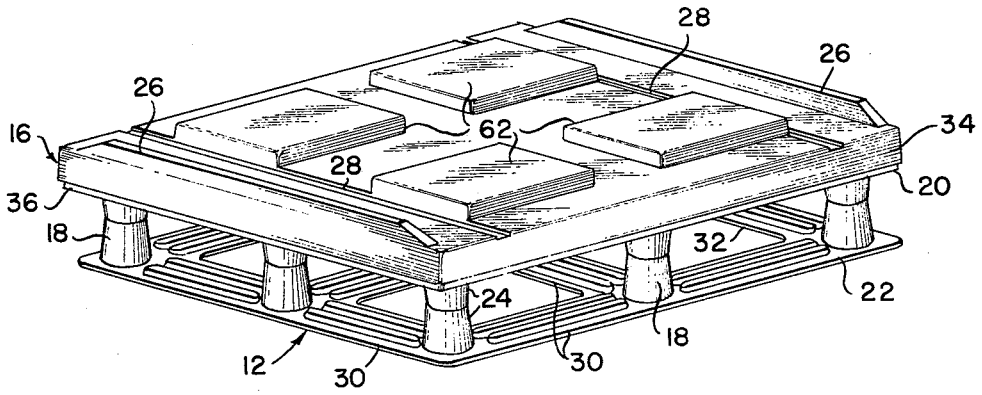
Fig. 2

COLLAPSIBLE SHIPPING CONTAINER

BACKGROUND OF THE INVENTION

This invention relates generally to shipping containers and, in particular, to a collapsible shipping container which is attachable to a four-way pallet by means of a plurality of resilient snap-lock fasteners which aid in sustaining the load carried in the container.

One of the major expenses incurred in the shipping industry is the uneconomical shipping of empty containers back to their place of origin after their contents have been delivered. In order to decrease the bulk of empty shipping containers and thereby increase the cargo capacity of cargo carriers, modern shippers have turned to collapsible containers which may be stored in the flat but may be subsequently erected for receipt of goods. In general, the combination of a shipping pallet and a knockdown shipping container is known. Tucker, U.S. Pat. No. 3,650,459 shows such a knockdown shipping container attached to a four-way pallet. Such shipping containers may be made out of a variety of material such as corrugated paper, aluminum, plastic, etc. Likewise, the pallets may be made out of metals or plastic materials such as polystyrene. Similar collapsible, palletized shipping containers which may be transported in their knocked-down state are disclosed in Severn U.S. Pat. Nos. 3,026,015; Kuppersmit 3,433,737; and Carroll 3,514,030.

One difficulty with modern systems is that they are often difficult to erect. A major problem in this regard is the connection of the pallet to the upper storage area of the container. The inventor has discovered that by the use of special pins it is possible to quickly and efficiently secure the pallet section to the upper storage section with a minimum of wasted effort and with a maximum of strength and security. In particular, the inventor uses a resilient snap-lock fastener comprising a pair of resilient arms extending from a base. Said arms compress inwardly to pass through a recess located to the pedestal feet of the shipping pallet and snap back to engage the lip of the recess in a groove formed by a pair of flanges carried on said arms. One member of said flange pair provides a cam surface which cooperates with the lip to inwardly compress the resilient arms as they pass through said recess. The other of said flange member provides a load-supporting surface which cooperates with the lip of the recess to help sustain the load contained in said containers. In this manner, a workman can secure the upper storage area to the pallet in a matter of minutes. For purposes of applicant's invention, he uses a pallet composed of an upper and lower half which includes raised portions which, when connected together, form the pedestal feet of the pallet. Cushman U.S. Pat. No. 2,699,912 and Westlake, Jr. U.S. Pat. No. 3,680,496 show pallets composed of upper and lower halves which are fastenable at the midsection of the foot portions thereof.

However, the particular fastening means do not appear to be disclosed in the prior art nor is the recognition and solution of the problem involved disclosed therein. Additionally, the cardboard forming the panel sections has been plied from the corner to outer edge to permit the panels to be bent outwardly enabling the contents of the carton to be inspected without disassemblying the container.

Further, thrust absorbing tabs are included by which vertical forces on the panel are converted into a horizontal component by a pivot action and are thereby absorbed by the corners rather than the relatively weaker wall.

Therefore, it is an object of the present invention to provide a shipping container which may be quickly and efficiently erected.

It is a further object of the invention to provide a shipping container which may be readily disassembled and stored conveniently when not in use.

It is a still further object of the present invention to provide a rugged shipping container which will withstand normal shiping use but which is readily accessible for inspection when necessary.

Another object of the present invention is to provide a collapsible shipping container which includes a four-way shipping pallet base and a collapsible upper storage section which is connectible to said pallet by means of a plurality of pins.

A still further object of the present invention is to provide a shipping container with internal thrust-absorbing tabs for improved vertical stacking strength.

It is yet another object of the present invention to provide a plurality of snap-lock fasteners for securing the base of a shipping container to a four-way pallet and for aiding in sustaining the load in said containers, having a pair of resilient arms extending from a flatbase compressible inwardly and adapted to cooperate with the lip of a recess to enable passage therethrough and engagement of said lip.

These and other objects and advantages of the invention will be more fully understood upon a reading of the following specification taken in view of the attached drawings wherein;

BRIEF DESCRIPTION OF THE DRAWINGS

FIG. 1 is a perspective view of the collapsible shipping container in the erected state;

FIG. 2 is a perspective view of the collapsible shipping container in the collapsed state;

DETAILED DESCRIPTION OF THE PREFERRED EMBODIMENT

Figure 3:
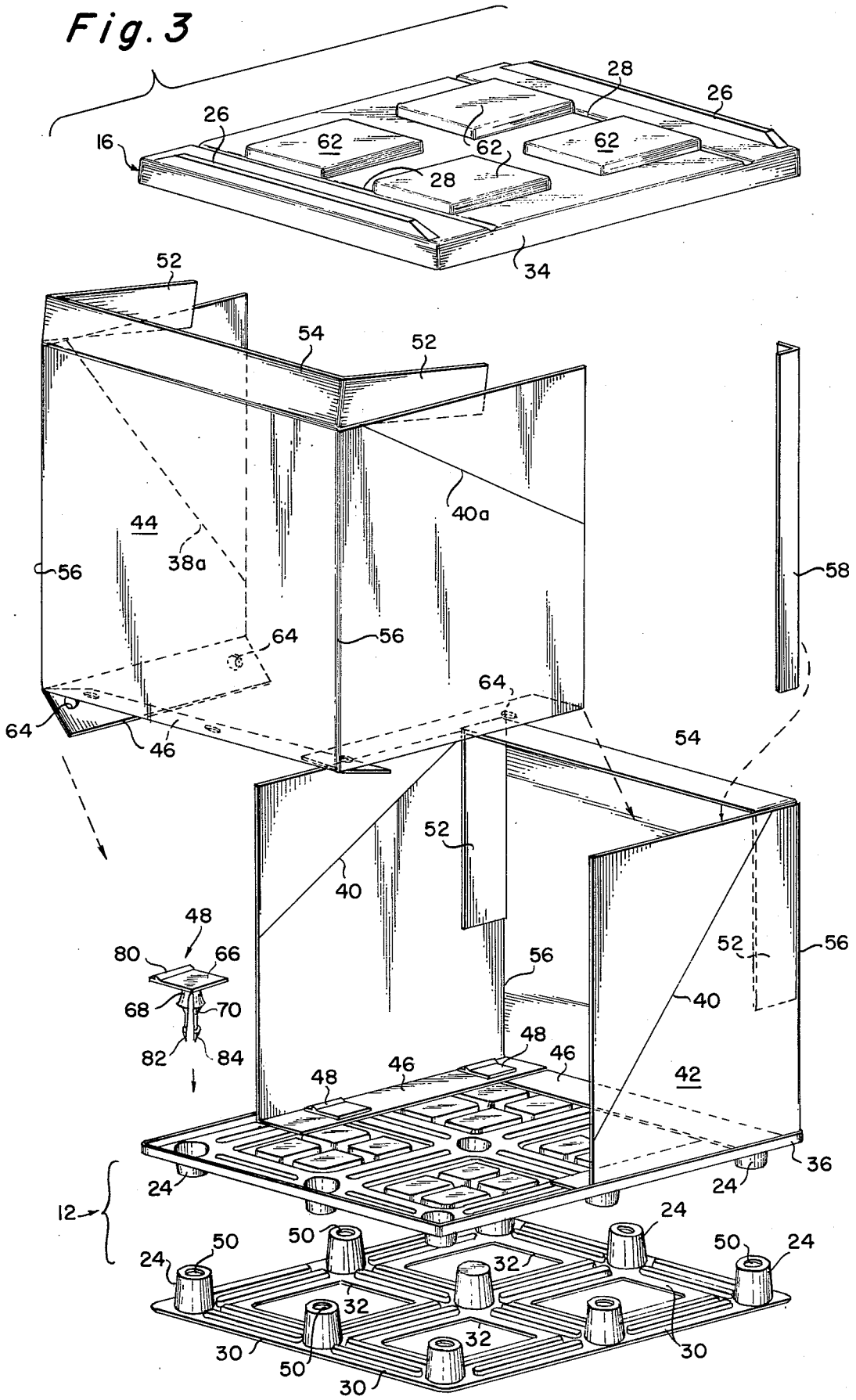
FIG. 3 is a partially exploded view of the interior of the shipping container.

FIG. 1 is a perspective view of the erected shipping container 10. This view illustrates, in particular, the pallet section 12, the upper storage section 14, and lid means 16 when the container is assembled. For shipping purposes it may be desirable to encircle the entire container with shipping straps 25 in order to increase rigidity and hold the lid in place. Pallet section 12 includes a plurality of foot pedestals 18 which are evenly spaced around the periphery of the pallet for easy access by a conventional fork lift truck. Pallet section 12 includes an upper half 20 and a lower half 22. Both upper half 20 and lower half 22 include raised portions 24 which join together roughly at the center of the pedestal formed thereby. The container shown in FIG. 1 may be stacked upon other identical containers for shipping purposes. Lid 16 includes embossings 62 which are sufficiently nested in square openings 32 defined by the stringer elements 30 of lower pallet half 22 such that when the containers are stacked one upon the other, movement of pallet section 12 and collapsible containers stacked above is restrained. An optional pair of parallel ridges 26 are spaced a distance apart slightly greater than the width of pedestal section 12 and may be additionally provided to restrain movement of the pedestal section 12 stacked above it.

In practice, it has been found that five containers can be conveniently stacked one on top of the other for shipment at sea and that three containers may be conveniently stacked in a cargo plane.

Typically, the upper section may have a measurement of one meter by one meter and 20 centimeters in width and would be built of either plastic or a sturdy corrugated cardboard. One particular advantage of this size and shape container is that it is fully intermodal and, therefore, may be used by conventional land, sea, or air transportation interchangeably. Likewise, the fourway pallet section 12 allows the container to be easily manipulated by a conventional lift truck, however, it is also adaptable for lifting by means of a conventional crane or derrick.

In order to further improve the security of the bundle, a set of grooves 28 in lid 16 restains straps 25 from lateral movement. This further improves the purchase that straps 25 achieve over the lid of the container.

The structural design of pallet section 12 is important for a variety of reasons. Lower half 22 of pallet section 12 includes a plurality of stringer elements 30 interconnecting foot pedestals 18. The purpose of stringer elements 30 is to improve the rigidity of the pallet section and also to more evenly distribute the weight of the container as it rests on the pallet. For design purposes, the stringers must be wide enough to support a load of approximately 200 pounds per square foot. Stringers 30 are also an improvement because they leave square openings 32 whose periphery is defined by the stringer elements themselves. Square opening 32 permits certain types of lift vehicles to get under pallet section 12 and at the same time allows wheeled contact with the floor surface directly beneath the pallet 12 within the square opening 32. The shipping container as shown in FIG. 1 has the ability to withstand and resist acceleration and deceleration forces up to 12 G's and shiprocking up to 25°. Such a force might be encountered when an aircraft makes a forced or emergency landing. One outstanding feature of the present invention is that the structure of the erected and collapsed container meets the requirements of major international customs and shipping organizations including: ISO, AFNOR, BSI, DIN, IATA, UIC, etc.

It should also be noted that portions of the upper and lower sections of the pallet 12 are waffled and corrugated in such a fashion as to lend extra strength to the materials employed and as to permit the use of a fork lift without damage to the corrugations. Likewise, lid means 16 employs a plurality of spaced islands 62 which add extra strength and which fit neatly into square openings 32 in the base of the lower half 22 of pallet section 12 thereby greatly decreasing the tendency of the containers to slide relative to one another when in the stacked position as described above. It is to be noted that the containers can readily be handled by a hoist and sling assembly as indicated in phantom.

The container of FIG. 1 is shown in its collapsed state in FIG. 2. In general, it has been found that five of the collapsed containers as shown in FIG. 2 have roughly the same volume as one made-up or erected container as shown in FIG. 1. In the collapsed state, the upper storage section is neatly folded into the flat and the fastening pins, side braces, and thrust-supporting tabs are all enclosed in a space between the lid 16 and the upper half 20 of pallet section 12. Lid 16 includes a lip 34 which is received over a corresponding lip 36 on the upper half 20 of the pallet section 12 as shown in FIG. 2. However, it would also be possible to extend lip 34 over corresponding lip 36 thereby preventing precipitation from entering the sides of the knocked-down container. The area defined by overlapping of lips 34 and 36 provides an interior space in which the side walls, pins, braces, and tabs may be neatly packed and stored. If desired, the collapsed pallet may be additionally strapped for knock-down security.

An exploded view of the collapsible container of FIG. 1 is shown in FIG. 3. FIG. 3 clearly reveals that the upper section 14 of container 10 includes a pair of U-shaped panels 42 and 44 which, when fastened to the pallet section 12 form the four side walls of the collapsible container. Panels 42 and 44 include an L-shaped base section 46 which is fastenable by means of snap-lock fastener 48 to an eye 50 in the raised portion 24 of the lower half 22 of pallet section 12. U-shaped panel sections 42 and 44 also include a pair of thrust tabs 52 attached to a foldable panel section 54. Tabs 52 which are shown in the upward position on panel 44 and in the engaged position on panel 42 are provided in order to increase the stacking strength of the container 10. Due to the hinged or pivotal nature of foldable panel 54 the vertical force on that panel is converted into a horizontal component by thrust tabs 52. The horizontal thrust is, in turn, absorbed by the corners 56 of U-shaped panels 42 and 44. In this manner, a portion of the vertical stacking load on the lid 16 is converted into a horizontal component which is partially dissipated by the panels 42 and 44. One novel feature of these tabs is that they do not extend completely to the floor and, therefore, all of the vertical load on said tabs is converted into a horizontal component but not into a vertical component directed against the L-shaped base section 46. For the foregoing reasons, the use of tabs 52 increases the stacking strength of collapsible container 10.

In each of the four corners 56 of the side wall panels there is located a rigid, L-shaped stay 58 which further increases the stacking strength of the container. While only one stay 58 is illustrated in FIG. 3, it is understood that in conventional use one stay is placed in each of the four corners of the container. Stay 58 is held up and against the corners 56 of the panels by means of abutting portion 80 carried by base 66 of fastener 48. The stay may be of any suitable rigid material such as plastic, light metal, corrugated paper, wood, etc.

The free side walls of the two U-shaped panels 42 and 44 are each scored to permit a portion of the side walls to be bent outwardly to permit inspection of the interior of the container without having to disassemble it. The U-shaped panel 42 is scored at 38 and 40 with the scoring 38 being at a greater angle than the scoring 40. Likewise, panel 44 is scored at **38*a* and 40*a*. When assembled, as seen in FIG. 3, the wall of the panel 42 having the score 38 thereon overlies the wall of the panel 44 having the score 40A thereon. Likewise, the panel having the score 38*a* overlies the panel 40. In other words, it is clear that the slope of the scores 38 and 38*a* is greater than the slope of the scores 40 and 40*a* and that panels 42 and 44 must be positioned such that when it is desired to inspect the interior of the container, the panels having the scores 38 and 38*a*** must be bent outwardly first to expose the scores 40 and 40*a*. In assembly, the lower end points of the scores 40 and 40*a* lie approximately on the scores 38 and 38*a*.

Figure 4:
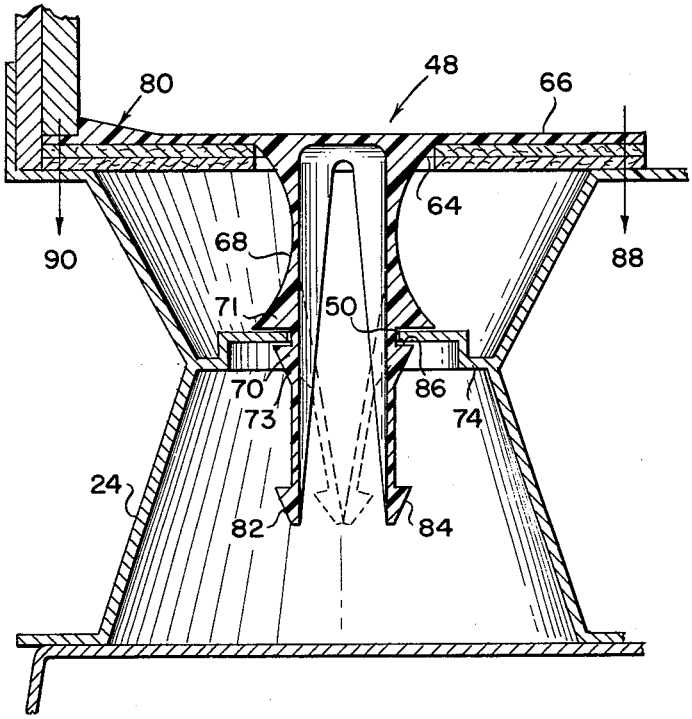
FIG. 4 is a front sectional view of a snap-lock fastener in situ.

FIG. 4 shows the position of snap-lock fastener 48 after it has been inserted through hole 64 in base section 46 of either U-shaped panel 42 or 44. The fastener 48 comprises a pair of resilient arms 82 and 84 extending from a flat base 66. Arm 82 being a mirror image of and functioning the same as arm 84 carries flanges 70 and 71 which cooperate to form a groove 86 which receives a lip 50 of lower pallet section 24.

As the arms of fastener 48 are inserted through recess 51 the surface 73 of flange 70 cooperates with lip 50 to compress the arms inward. Once flange 70 passes lip 50 the arms snap back to engage lip 50 in groove 86. This arrangement has the added advantage that once the fastener is in place, the load is not only sustained at points 88 and 90, but also at surface 75 of flange 71.

The fastener can only be removed manually by pinching arms 82 and 84 at surface 92 provided for that purpose.

In operation, the erection of the collapsible container as shown in FIG. 1 is relatively simple. A workman, who does not necessarily have to possess any special skills, simply takes the two U-shaped panels and sets them up as shown in FIG. 3 with the base section 46 contacting the upper half 20 of pallet section 12. When the base section is so aligned, the panels are then moved so that base holes 64 directly coincide vertically above recess 50 in foot pedestals 18. At that point, a workman simply inserts fasteners 48.

Once the base section is secured to the pallet section the stays 58 are inserted in each of the four corners of the container and secured by abutting portion 80 and thrust-bearing tabs 52 are bent downward vertical to the height of the container as illustrated on panel 42 in FIG. 3. Thereafter lid 16 may be placed over the top of the partially completed container and may be secured thereto by means of straps 25. Of course, before the lid section 16 is placed on top of the panel sections it is necessary to fill the box with whatever contents it may contain. Alternatively, of course, the container could be erected around the contents that it ultimately surrounds and thereby avoiding the necessity of lifting the contents over the top of the box and into it. Likewise, it is not absolutely necessary that stays 58 go in position before thrust tabs 52 are adjusted to their correct attitude. Stays 58 can be placed in later.

Figure 5:
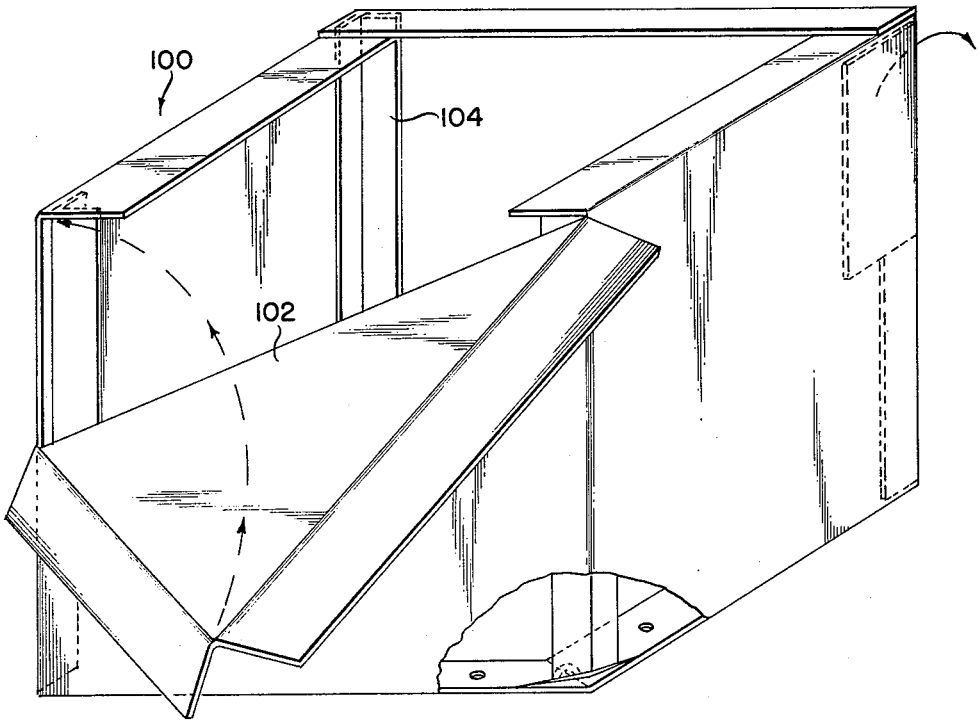
FIG. 5 is a perspective view of the shipping container in its open state for inspection purposes.

FIG. 5 shows a modified form of the container of this invention wherein, instead of making the box from two U-shaped panels, this box is composed of a four-wall unitary section. In order to permit the container walls 100 to be folded in a manner so that it will fit the top and bottom sections of the container when in the collapsed condition, the container 100 may come with one side wall being unattached to one end so that the side walls can be folded upon each other. In any event, at least one side wall, and perhaps two, of the container 100 is scored at 102 to permit inspection of the interior of the container. The portion above the scoring 102 is swung outwardly as indicated in the figure. Without going into detail of the structure of the embodiment of FIG. 5 it is to be understood that it is attached to the pallet in much the same manner as the container described in FIGS. 1 through 3. Further, each of the corners are provided with side wall braces 104 which lend vertical and horizontal rigidity to the container.

In a general manner, while there has been disclosed effective and efficient embodiments of this invention, it should be well understood that the invention is not limited to such embodiments as there might be changes made in the arrangement, disposition, and form of the parts without departing from the principle of the present invention as comprehended within the scope of the accompanying claims.

I claim:

1. A collapsible shipping container comprising an upper section and base portions, a pallet for supporting said upper section, and fastener means for attaching said upper section to said pallet, said pallet having openings therein, said base portions having openings therein overlying said openings in said pallet, said fastener means including a flat base, resilient arms extending from said base, said arms extending through the openings in the pallet and through the openings in said base portions, each of said resilient arms carrying a flange pair defining a groove for receiving a portion of said pallet surrounding said openings, one member of said flange pair providing a surface which rests on said portion of said pallet and thereby shares in sustaining the load in said container.

2. The collapsible shipping container of claim 1 wherein said container comprises side wall means including a pair of generally U-shaped panels which when fastened to said base means overlap to form four walls of said container.

3. The collapsible shipping container of claim 2 wherein said upper section includes a detachable lid which in combination with said side walls, said base means, and said pallet, forms an enclosed container.

4. The collapsible shipping container of claim 3 wherein said U-shaped cardboard panels are each provided with a score line along a predetermined path to permit outward bending of said panels for an easily accessible opening where they overlap.

5. The collapsible shipping container of claim 2 wherein each of said U-shaped panels includes a pair of thrust-absorbing tabs which extends partially toward the bottom of said container when in position and which transform at least part of a vertical stacking load into a horizontal component directed toward the sides of said U-shaped panels.

6. The collapsible shipping container of claim 1 wherein said pallet is a four-way pallet accessible by fork lift truck from all four sides.

7. The shipping container of claim 6 wherein said pallet further includes an upper and a lower half, each half including a plurality of raised portions, which, when connected together, form a plurality of pedestals.

8. The collapsible shipping container of claim 1 wherein said pallet is a four-way pallet accessible by fork lift truck from all four sides.

9. The collapsible shipping container of claim 8 wherein said pallet further includes an upper and a lower half, each half including a plurality of raised portions which, when connected together, form a plurality of pedestals.

10. The collapsible shipping container of claim 9 wherein said pallet includes at least eight of said pedestals.

11. The collapsible shipping container of claim 1 wherein the other of said flange pair cooperates with said the portions of said pallet surrounding said opening to compress said resilient arms as they pass through said recess.

12. The collapsible container of claim 1 wherein said flat base of said fastener means has an upper surface and including a flange on said upper surface spaced from one end of said flat base, and wherein said pallet has an upstanding flange around its perimeter, said flange on said flat base and said upstanding flange providing a groove for receiving the bottom edges of said U-shaped panels, whereby said bottom edges are restrained from lateral movement away from said upstanding flange.

13. A collapsible shipping container comprising, an upper storage section, a pallet for supporting said upper storage section, and fastening means for attaching said upper storage section to said pallet, said upper storage section including a pair of U-shaped panel sections each having base means which are securable to said pallet by said fastening means, said pair of U-shaped panel means overlapping so as to form four walls of said container, each of said U-shaped panels including a pair of thrust-absorbing tabs which extend partially toward the bottom of said container when in position, said tabs connected by a horizontal panel extending along the upper edge of one side of said container, said tabs transforming at least part of a vertical stacking load into a horizontal component directed toward the sides of said U-shaped panels.

14. The collapsible shipping container of claim 13 wherein said U-shaped cardboard panels are provided with a score line along a predetermined path to permit outward bending of said panels for an easily accessible opening where they overlap.

* * * * *